US006935345B2

(12) United States Patent
Carstens et al.

(10) Patent No.: US 6,935,345 B2
(45) Date of Patent: Aug. 30, 2005

(54) METHOD FOR GENERATING SMALL BUBBLES FOR A SMOKE-FILLED AIR STREAM

(76) Inventors: Christopher Carstens, 1042 Tropic Ave., Santa Ana, CA (US) 92705; Daniel Carstens, 1042 Tropic Ave., Santa Ana, CA (US) 92705

( * ) Notice: Subject to any disclaimer, the term of this patent is extended or adjusted under 35 U.S.C. 154(b) by 236 days.

(21) Appl. No.: 10/377,417

(22) Filed: Feb. 28, 2003

(65) Prior Publication Data

US 2003/0159701 A1 Aug. 28, 2003

Related U.S. Application Data

(60) Provisional application No. 60/360,319, filed on Feb. 28, 2002.

(51) Int. Cl.[7] ..... A24F 1/30

(52) U.S. Cl. ..... 131/173; 131/211; 131/212.1; 131/212.2; 128/200.24

(58) Field of Search ..... 131/173, 200, 131/211, 212.1, 212.2, 216, 329; 128/200.24, 203.12, 203.16, 205.12, 205.27

(56) References Cited

U.S. PATENT DOCUMENTS 4,241,741 A * 12/1980 Cabados et al. ..... 131/173
4,357,948 A 11/1982 Schweitzer et al. ..... 131/173

* cited by examiner

*Primary Examiner*—Dionne A. Walls
(74) *Attorney, Agent, or Firm*—David T. Bracken

(57) ABSTRACT

The present invention is a small bubble generator in a water stage cleaning and cooling a smoke filled air stream. A demister is a second embodiment of the invention to remove entrained water droplets from a cleaned and cooled smoke filled air stream issuing from the water stage.

16 Claims, 7 Drawing Sheets

FIGURE 6
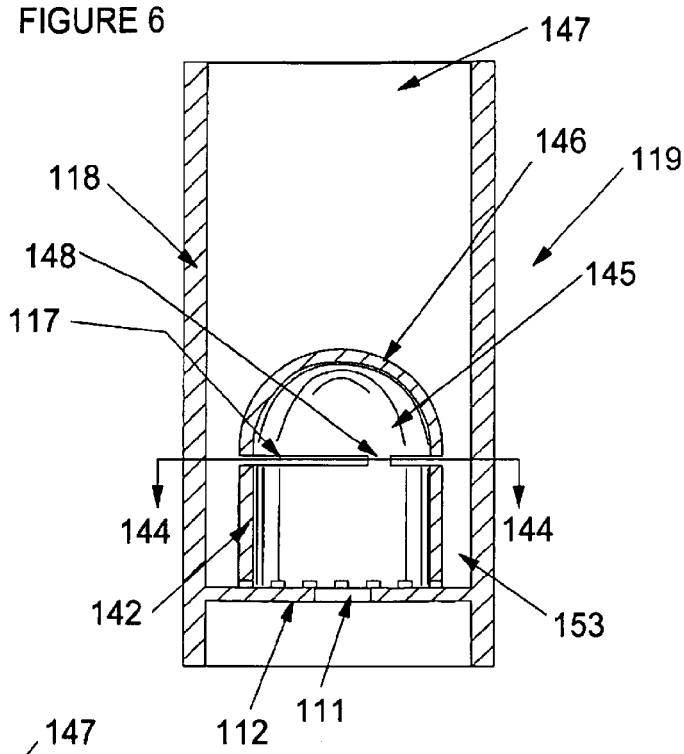
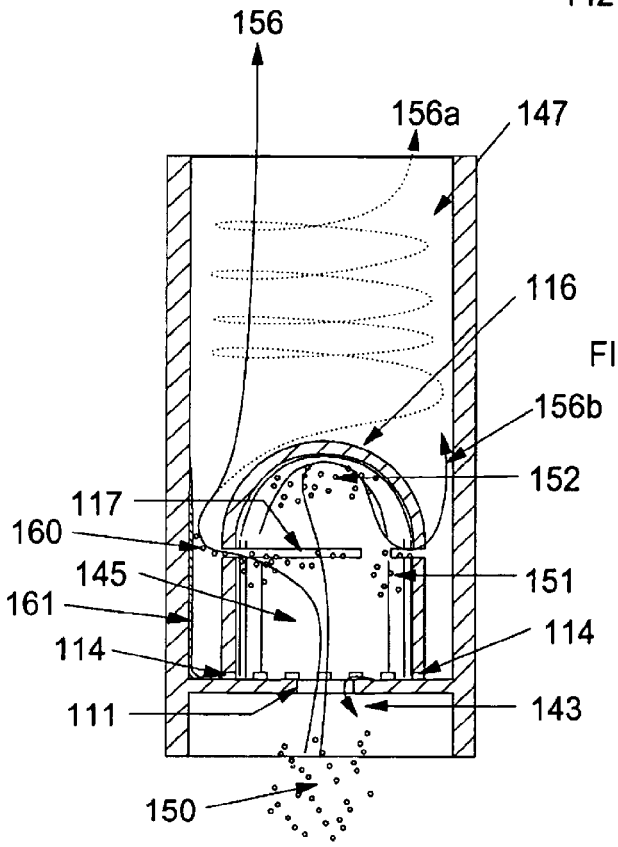
FIGURE 7

METHOD FOR GENERATING SMALL BUBBLES FOR A SMOKE-FILLED AIR STREAM

This application claims the benefit of Ser. No. 60/360,319 filed Feb. 28, 2002.

BACKGROUND OF THE INVENTION

The present invention relates to water pipes using more than a single stage of water to condition smoke before it reaches the user's mouth.

U.S. Pat. No. 4,357,948 shows a water pipe with a device located in a tube above a bottom water reservoir. The device can only form large and non-uniform bubbles from smoke filled air passing through water retained in the device. The device loses almost all effectiveness when tilting it more than a few degrees from vertical, as a relatively low water head at one side of the tube allows all the smoke filled air to escape through the water at the point where the depth is smallest.

SUMMARY OF THE INVENTION

A first embodiment of the invention is a small bubble generator system for smoke filled air generated from in a pipe and drawn by vacuum force of human lungs through a water stage. The first embodiment preferably processes the smoke filled air after contact in large bubbles with a main body of water. The main body of water may be the lowest bowl or container of water in a prior art water pipe.

A small bubble generator by the invention process has proven to have resulted in a dramatically more pleasurable smoking experience for the user. The reasons for this improvement are clear in retrospect after the inventors experimented with several alternate methods.

Smoke filled air drawn from a pipe bowl or from another source of burning vegetable matter is hot and filled with microscopic particles comprising carbon, tars, partly burned vegetable matter fibers, dirt and dust, and other non-volatiles, as well as vaporized hydrocarbons, pesticides, carbon dioxide, carbon monoxide, and typical components for reduced oxygen air. The components of smoke that are desired by the user are typically a complex mixture of hydrocarbons and a sometimes a portion of the particulates.

Excluding the desirable components, the balance of the components are undesirable and typically unhealthy. A user would prefer to exclude at least some of the undesirable components. In addition, a typical user has been found to prefer a lower temperature smoke filled air stream to draw into their lungs, albeit a stream sufficiently high in the desirable components to provide the smoking experience desired. In this application, the phrase "first smoke stream" will refer to a smoke filled air stream drawn directly from a pipe bowl or from another source of burning vegetable matter by vacuum force of only human lung power.

Conventional water pipes capture some of the undesirable components of the first smoke stream and cool the stream some few degrees. This is done by drawing that first smoke stream to a bottom of a lower bowl of water to form in the water relatively large bubbles that rise through the water. A relatively large gas space is provided above the water for disengaging water droplets from the released bubbles. The diffusers in that lowest bowl for the first smoke stream are commonly just glass or metal tubes that run from a pipe bottom to an end under the water, where the first smoke stream exits the tube through a few holes. The bubbles exiting those holes have an average inside diameter of about 3 millimeters or more.

The inventors have found that reducing the average inside diameter of the bubbles to about 2 millimeters or less in one or more water stage upstream of a user dramatically reduces the emerging gas temperature and removes substantially more of undesirable smoke components that prior art devices. However, making small bubbles in a smoke filled gas stream has an important cost.

Making a gas stream to pass through a small hole is the best way to make a small bubble. A gas stream with particulates and tars will eventually plug that hole. That is the cost of making small bubbles for water pipes.

The present inventors attempted replacing the holes in the end of the glass or metal tube in a water pipe with a sintered "stone" used in aquariums to generate small bubbles. The device worked well to make small bubbles but had a very short life. The small passages of the stone plugged and could not be cleaned. The present inventors then experimented with several alternate structures to arrive at the first embodiment of the invention. The first embodiment accelerates a smoke filled gas stream to impinge on an underside of a top cap and then down from the top cap to small accelerator openings that emit the smoke filled gas as small bubbles into a volume of water. The pressure drop of the gas across the accelerator openings that is substantially greater than the pressure drop through the water the bubbles encounter on the water stage. This means a user may tilt the invention water stage to 45 degrees or more with little, if any, reduction in desired performance.

A second embodiment of the invention is a mist eliminator. The act of drawing smoke filled air through water with inhalation vacuum of a human typically generates substantial water droplets carrying upward from the surface of the water. However, prior art water pipes have been designed with very substantial upward extensions of the enclosure above the lowest bowl of water and/or expanded lateral cross sections above the water so that the water droplets from that lowest bowl of water do not reach the user's mouth. tubes very extended When a water stage is placed somewhat nearer the user's mouth than the water level of water in a lowest bowl or container of water in a prior art water pipe, a sensible and annoying amount of water droplets get pulled into a user's lungs. The second embodiment is similar to the first embodiment but eliminates a central tube with an annular space within the structure of the top cap. The droplet laden gas stream impinges on an underside of that structure and is forced through elevated side slots to impinge on the inside surface of the largest bore of the outside housing. The droplets adhere to one of those impingement surfaces and drain to a water stage below the second embodiment.

BRIEF DESCRIPTION OF THE DRAWINGS

FIG. 6 is a close up of section 119 of FIG. 1.

FIG. 7 is an operational view of FIG. 6 in an upright position.

DETAILED DESCRIPTION OF THE INVENTION

The invention is now discussed with reference to the figures.

Figure 1:
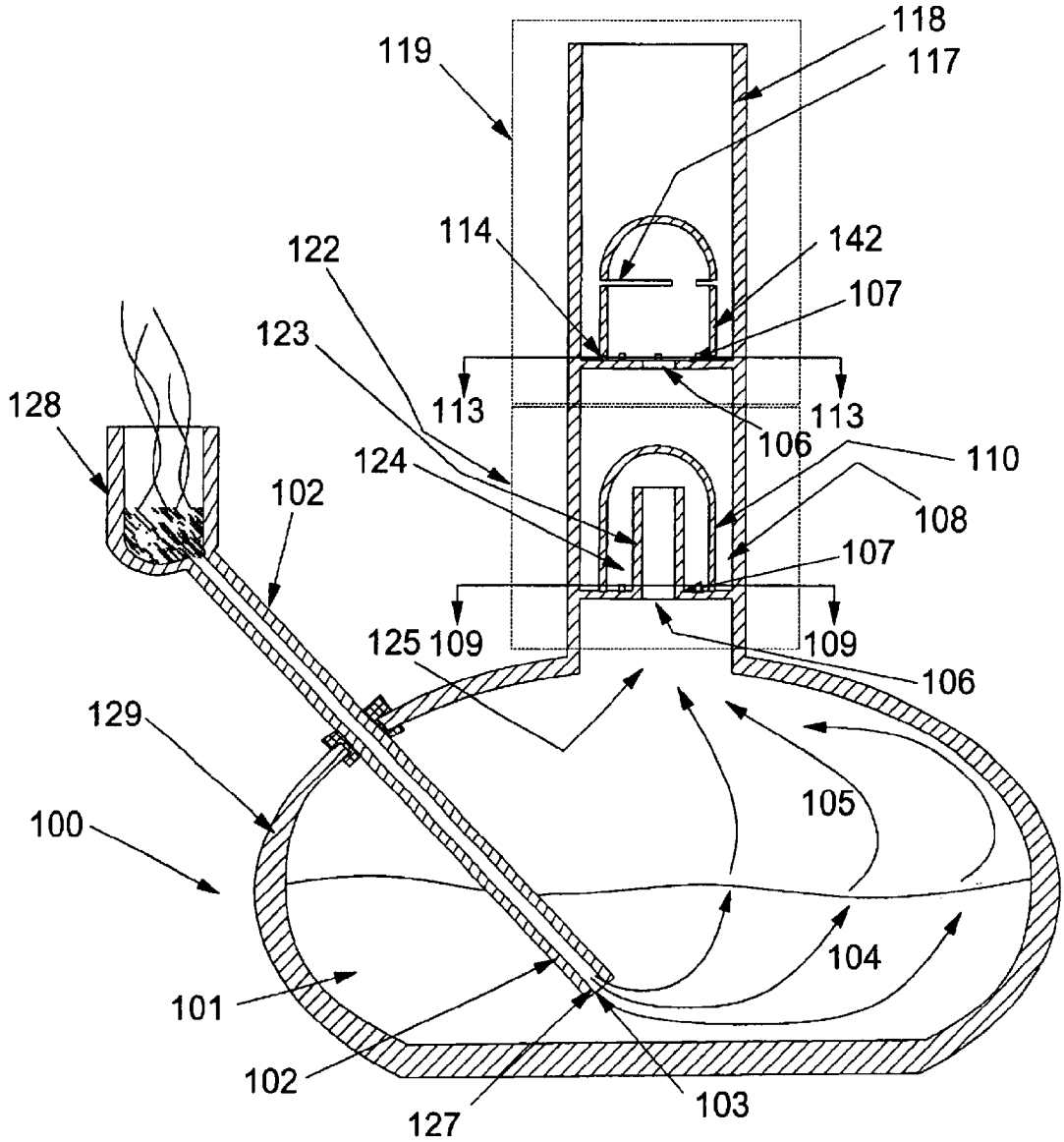
FIG. 1 is side and cutaway view of a lower water reservoir with two embodiments of invention stages shown above it.
Figure 2:
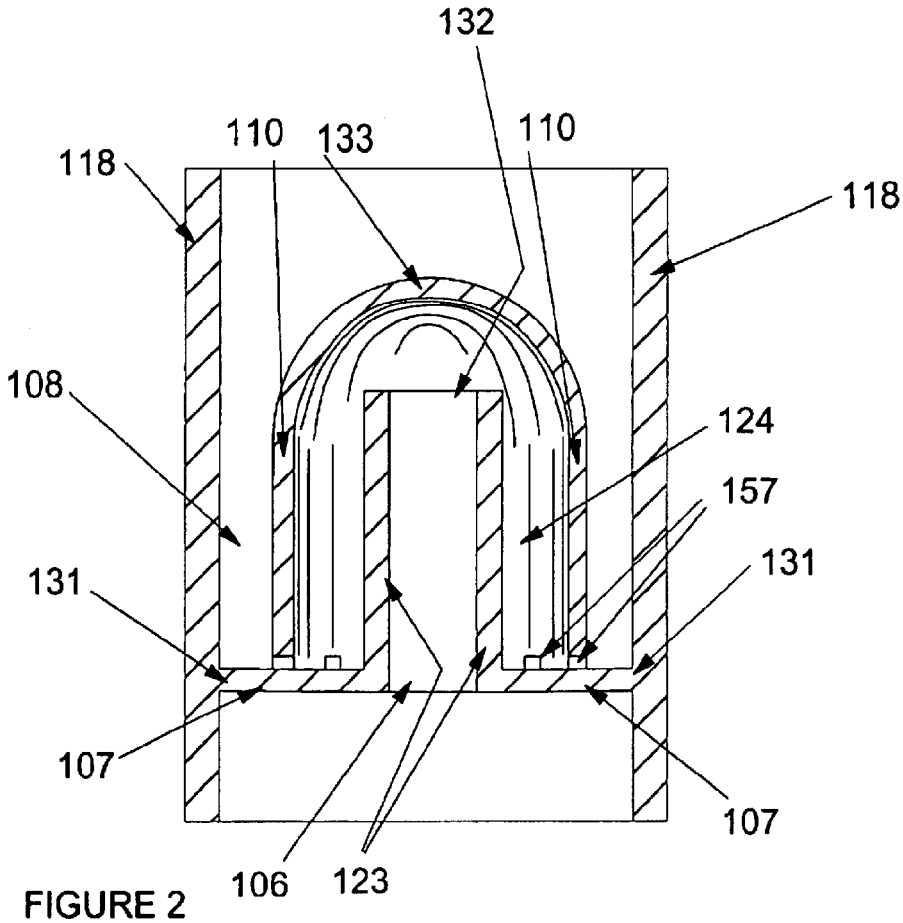
FIG. 2 is a close up of section 122 of FIG. 1.

FIG. 1 shows a water pipe 100 with the two invention stages 109 and 113. Additional upwardly sequential stages 109 and 113 can be stacked on the stages shown so that housing 118 with the central bore extends upward to accommodate those stages. Stage 109 is an invention water stage of the first embodiment. Stage 113 is an invention demister stage of the second embodiment. Each of stages 109 and 113 can operate independently of each other. Stage 109 may be primary water stage processing a first smoke stream or may process smoke filled air streams downstream of other processing stages. Stage 113 may act as a demister without the previous process of smoke filled gas accomplished on stage 109. Stage 113 can remove water droplets from smoke filled air from a water stage such as that shown in FIG. 1 in container 129.

Container 129 in FIG. 1 is preferably a glass or other water containing container that can retain a water volume 101. Pipe bowl 128 retains burning vegetable matter, and a first smoke stream 103 is drawn from bowl 128 through tube 102 through diffuser end 127. Stream 103 issues from diffuser end 127 as bubbles greater than about 3 millimeters in water volume 101 to form bubble stream 104. The bubbles of stream 104 burst and form second smoke stream 105, which in turn flows to opening 125 at the base of housing 118. Stream 105 passes through opening 125 and into stage 109, wherefrom a third smoke stream passes to stage 113. After the third smoke stream is processed in stage 113, it emerges as a fourth smoke stream from a top end of housing 118 to be drawn into a user's mouth and lungs.

With reference to FIGS. 1–5, stage 109 comprises a portion of housing 118 and its central bore. To an inside wall of the central bore is sealed floor plate 107. Plate 107 defines an opening 106, from which extends upward a tube 123 that ends in opening 132. A preferred inside diameter of tube 123 is from about 5 to about 20 millimeters and a more preferred inside diameter is from about 10 to 14 millimeters. Enclosing tube 123 is a structure comprising a top cap 133 extending down to side walls 110, at whose base are located small accelerator holes 157. Holes 157 in a first embodiment are rectangular extending from a top of floor 107 up to a height of from about 0.5 to about 4.5 millimeters and a width of from about 0.5 to 5.5 millimeters with a hydraulic cross section area of about from 1–10 square millimeters, and more preferably from about 2–4 square millimeters.

Figure 3:
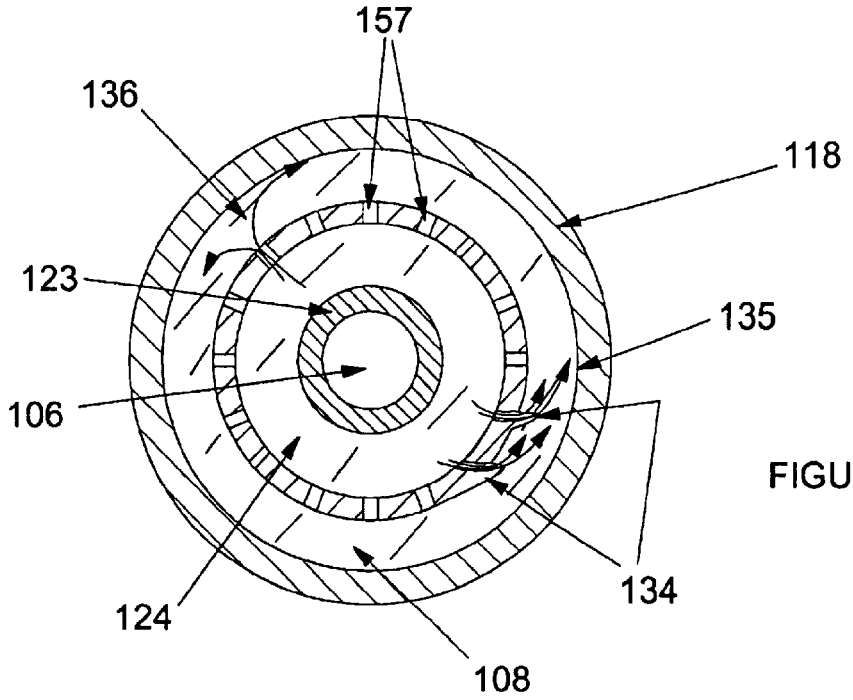
FIG. 3 is cross section 109 of FIG. 1.

An inside surface of housing 118 and an outside surface of walls 110 define annular space 108. An inside surface of walls 110 and outside walls of tube 123 define annular space 124. The sole connection fluid conduit connections between space 108 and 124 are holes 157. Space 108 opens to an open area within housing 118 above cap 133. An alternate embodiment of holes 157 are shown in FIG. 3. Holes 134 comprise extensions so that fluid exiting space 124 to space 108 is forced into a tangential or other angled relationship to the straight through orientation of holes 157. Holes 134 result in fluid direction 135 as fluid is drawn from space 124 to space 108. Holes 157 result in fluid direction 136 as fluid is drawn from space 124 to space 108. A preferred clearance between the top of tube 123 and the topmost part of the underside of cap 133 is about 0.25 to 2 inches. Generally, the small openings may direct gas flow radially, tangentially or at any other angle with respect to the outside surface of the wall defining the small opening.

Figure 4:
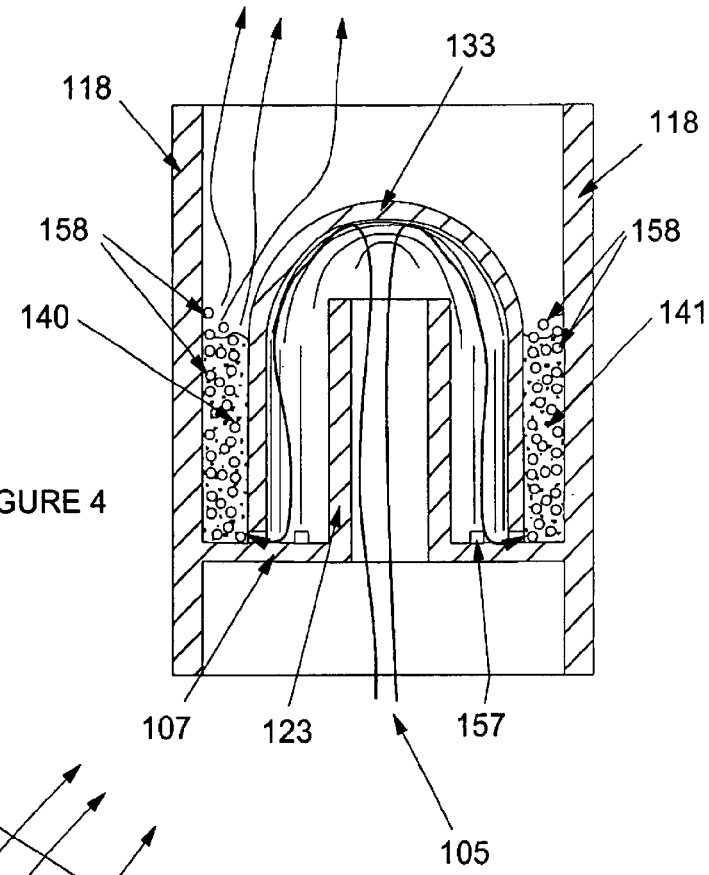
FIG. 4 is an operational view of FIG. 2 in an upright position.
Figure 5:
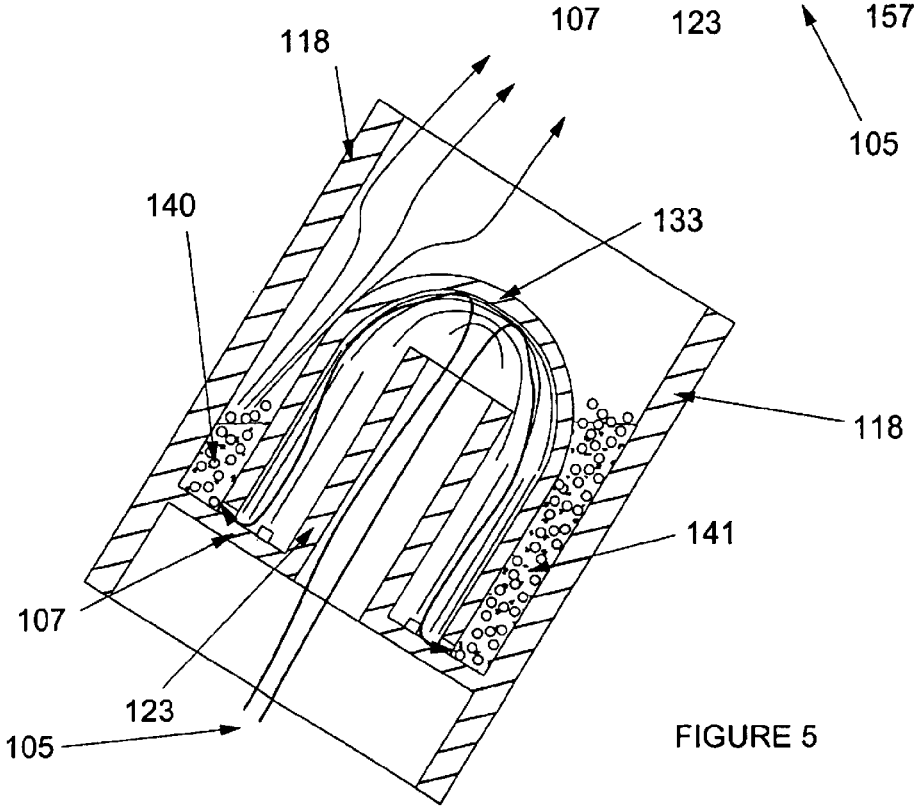
FIG. 5 is an operational view of FIG. 2 in a tilted position.

The operational FIGS. 4 and 5 are now referred to with respect to the invention process for the first embodiment. Second smoke stream 105 is drawn by vacuum force of human lungs into opening 106 from the much wider cross section below it defined by the inside walls of housing 118. This dramatically increases the velocity of stream 105. Stream 105 passes through tube 123 to impinge on the underside of cap 133, causing substantial turbulence and swirling. From cap 133, stream 105 is drawn down through space 124 to holes 157. The cumulative hydraulic cross section area of all of holes 157 is preferably much less than that of space 124 so that stream 105 passing through those holes 157 in one form of the invention experience a substantial acceleration. Stream 105 then passes into liquid 140 and liquid 141 (preferably water), liquids 140 and 141 being located on substantially opposite sides of space 108. Liquids 140 and 141 remain outside of space 124 by action of stream 105 passing into them, although when stream 105 is not flowing, liquid may flow into that space 124. If the level of liquids 140 and 141 are too high when stream 105 is not flowing, excess liquid spills into tube 123 and down to a next water stage. Water added from above stage 109 can spill into space 108 and will thereby only rise to the level of the top of tube 123. This is a method of adding water needed for operation of the invention water stages.

Bubbles 158 in FIGS. 4 and 5 have an average internal diameter of from about 0.5 millimeters to about 2 millimeters. A feature of the invention process is found in the acceleration of stream 105 through the small accelerator holes. Bubbles 158 move initially after formation from stream 105 in directions 136 or 135 shown in FIG. 3. When acceleration is substantial, this forces small bubbles into intimate contact with the inside wall of housing 118, where electrostatic attraction for a glass or metal surface causes the bubbles to frictionally resist rising as if open water. This increased residence time improves heat and mass transfer between the bubbles and the liquids 140 and 141. Thus, more undesirable components are removed and the temperature is reduced by humidification of the gas in the bubble.

FIG. 5 shows that the first embodiment is very adaptable to tilting, an activity that lets a user move about with the device 100. In FIG. 5, liquid 140 has a much reduced liquid pressure head compared with that shown in FIG. 4 and even much less than that of liquid 141 of FIG. 5. In prior art devices, stream 105 would necessarily flow almost entirely through fluid passages to the shallow liquid 140 side because the pressure drop has been reduced. In the first embodiment, the pressure drop across holes 157 is so substantial that the change in liquid head height has little effect on the operation of reducing temperature and removing undesirable components. In FIG. 5, it can be appreciated that the bubbles 158 of liquid 140 have a short residence time in the water or liquid, where the bubbles 158 of liquid 141 have a relatively long residence time in the water or liquid. So, where in FIG. 5 about half of all the bubbles would be less treated in liquid 140, the other half would be over treated in liquid 141. The invention uses small holes for bubble generation around a lower part of a periphery of a shell with a relatively large outside diameter. The result is even distribution of smoke filled air flow among the holes to that periphery so that substantially the entire volume of water or other liquid is in close contact with smoke filled bubbles. The prior art does not disclose such an efficient device as the invention.

Figure 8:
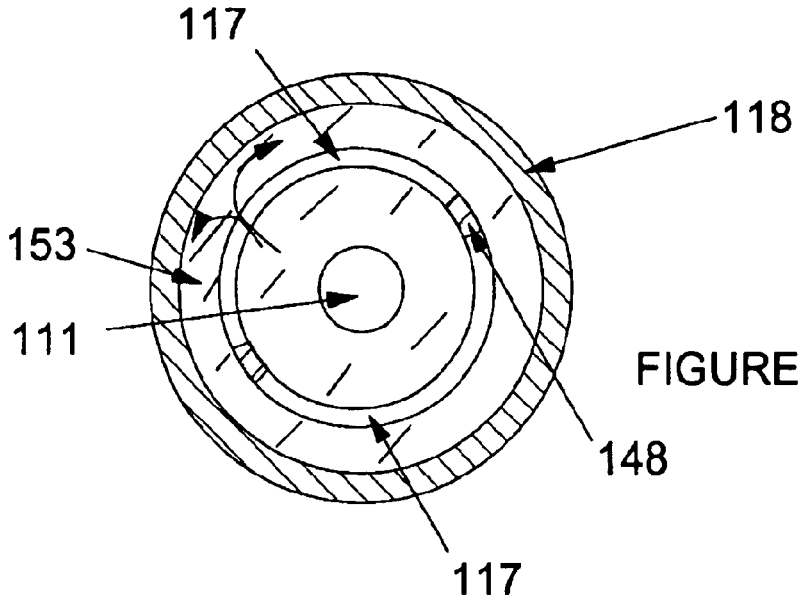
FIG. 8 is cross section 113 of FIG. 1.
Figure 9:
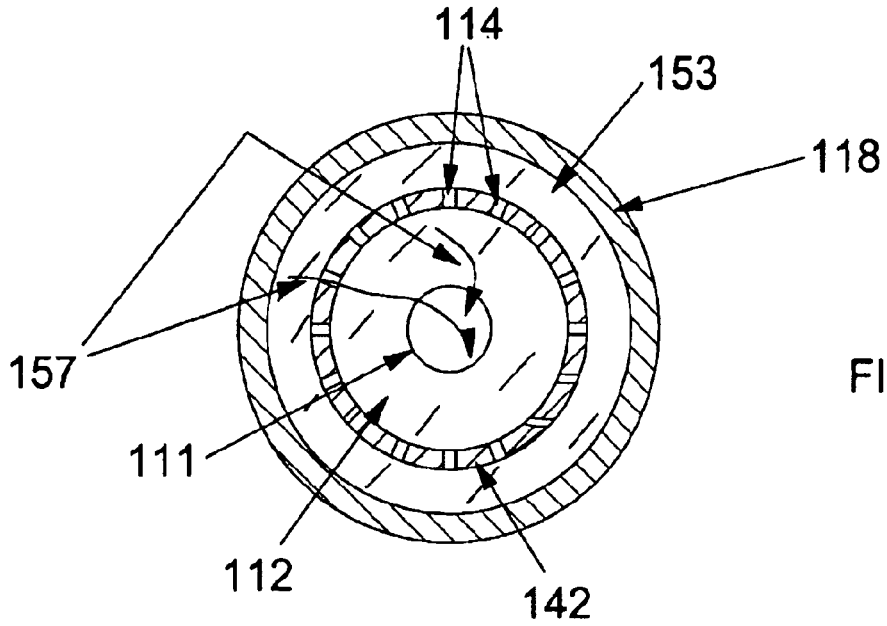
FIG. 9 is cross section 144 of FIG. 6.

FIGS. 7–9 are a second embodiment of the invention. FIG. 7 shows that a floor 112 seals to the inside surface of the largest bore of housing 118. Floor 112 defines opening 111 that opens to a space 145 defined by cap 146 (similar in structure and function to cap 133) and walls 142. Openings 114 communicate between space 145 and annular space 153 between the inside walls of the largest bore of housing 118 and the outside surface of walls 142. Slots 117 are formed about an inch or more below the top of cap 146 and at about a transition from walls 142 to cap 146 and are supported at sections 148 (shown in FIG. 8). The operation of the demister is shown in FIG. 7. Water droplets are carried up by a third smoke filled gas stream 150 through opening 111 into space 145. Droplets 152 impinge on an underside of cap 146, adhere thereon and drain down walls 142 to opening 111 where water flow 143 drains to a water stage below. Droplets 160 are drawn through slots 117 and impinge on the inside walls of the largest bore of the housing where they adhere and drain in film 161 to flow 157 through openings 114.

Figure 10:
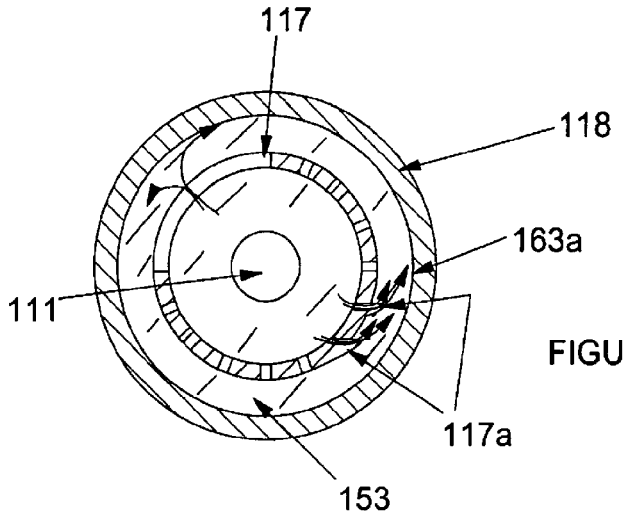
FIG. 10 is cross section 144 of FIG. 6 with an alternate slot form.

The second embodiment, with vane slots 117*a* of FIG. 10, surprisingly causes stream 150 being drawn through vane slots 117 to be forced into an especially pleasing spiral pattern in space 153 in paths 156*a* (in FIG. 7) and 163*a* (in FIG. 10). Streams 156, 156*a* and 156*b* leave space 147 conditioned to be inhaled by a user.

Figure 11:
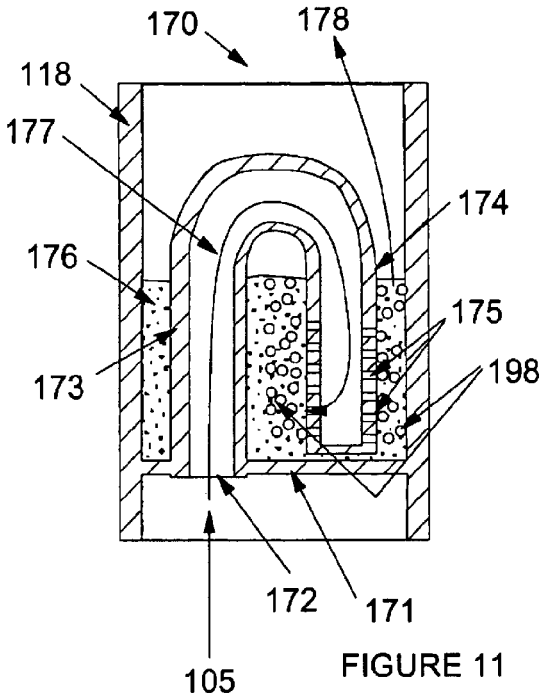
FIG. 11 is an axial cross section view similar to FIG. 4 with another form of the first embodiment.
Figure 12:
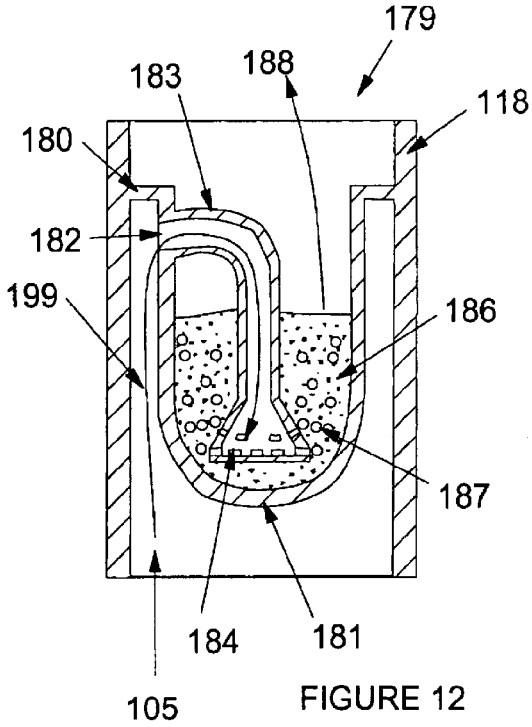
FIG. 12 is an axial cross section view similar to FIG. 4 with another form of the first embodiment.
Figure 13:
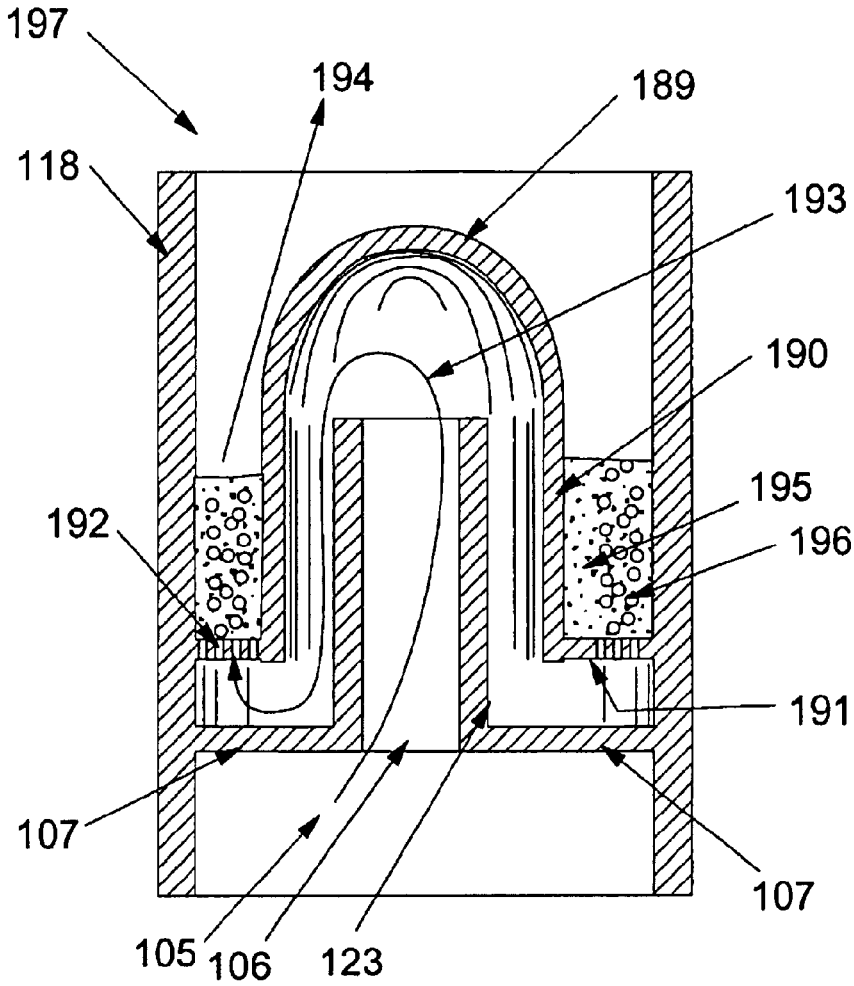
FIG. 13 is an axial cross section view similar to FIG. 4 with another form of the first embodiment.

FIGS. 11, 12 and 13 are alternate forms of the first embodiment. FIGS. 11, 12 and 13 respectively show small bubble generating stages 170, 179 and 197. Each respectively has a housing bore-sealing floor 171, 180 and 107. FIG. 11 shows that opening 172 in floor 171 extends to an upside down U-tube 173 that extends above the level of liquid 176 and back into liquid 176 to end part 174 that has small openings 175 with the bubble generating capabilities of the above first embodiments. Stream 105 passes through tube 173 on path 177 to form bubbles 198, which are released from the liquid 176 to form stream 178. The form of FIG. 11 somewhat reduces the fabrication costs, although the requisite narrow tube 173 will typically cause the bubbles 198 to pass through only a relatively small portion of liquid 176.

The form of FIG. 12 improves the liquid distribution of bubbles 187 in liquid 186 contained in container 181. Container 181 is a downward extension of a large opening in floor 108, which is sealed to the inside bore of housing 118. A tube 183 extends from an upper opening 182 in the side wall of container 181 down into liquid 186 to a flared end 184 that comprises the invention small openings in a periphery of end 184. Stream 105 enters stage 179 and along path 199 is drawn into an annular space between the outside walls of container 181 and the inside of the bore of housing 118, thereafter into tube 183 and out the small openings into liquid 186 to form bubbles 187. Bubbles 187 are freed from liquid 186 to form stream 188.

The form of FIG. 13 as stage 197 is similar to the form of FIG. 4, except that wall 190 is extended laterally at floor 192 to sealingly connect with the inside bore of housing 118. A space is formed between the upper surface of floor 107 and the underside of floor 191, in which are formed the invention small openings 192. Stream 105 is drawn into stage 197 along path 193, into tube 123 and then into the annular space between the outside of tube 123 and the inside of cap 189 that extends down to walls 190. Bubbles 196 are formed in liquid 195 as the smoke filled gas is drawn through openings 192, which are then released to form stream 194.

It is an especially important feature of the embodiments that they are easily cleaned with an alcohol and salt solution. It preferred that at least two successive first embodiment water stages are used above the first water contact of the first smoke stream of FIG. 1.

It will be seen that the forms of the first embodiment provide that the small openings may be located in a lower or lowest edge of a conduit which is immersed in the filtering liquid.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

We claim:

1. A method for generating small bubbles for a smoke filled air stream, where the smoke filled air stream is generated by human inhalation of air through burning vegetable matter causing the smoke filled air stream to be drawn through an intervening water stage, comprising:

(a) generating the smoke filled air stream;

(b) drawing the smoke filled air stream into a lower opening of a largest bore of an outer housing, the bore having a longitudinal axis from the lower opening to an upper opening, whereto human inhalation vacuum force is applied as the sole force for generating the smoke filled air stream;

(c) providing a first plate that seals the bore except for a first opening in the first plate about the bore axis and also providing an open ended tube extending from the edges of the first opening along the bore axis to a first height, whereby the smoke filled air stream flows from the first opening through the open ended tube to a second opening at the first height;

(d) providing an enclosure for the open ended tube with a cap on top of walls that extend up from a top surface of the plate to define a first annular space between an outside surface of the tube and an inside surface of the walls and a second annular space between an outside surface of the walls and an inside surface of the bore, where small accelerator openings are provided at a lower part of the walls between the first and second annular spaces;

(e) providing a water based liquid in the second annular space and flowing the smoke filled air stream from the second opening of the tube through the first annular space, substantially accelerating the smoke filled air stream by flowing it through the small accelerator openings and forming small bubbles therewith in the water based liquid; and (f) flowing the small bubbles to a surface of the water based liquid and thereby reducing the temperature of the smoke filled air and capturing a substantial portion of its undesirable components to form a first cleaned smoke stream.

2. The method of claim 1 wherein the top of the tube and an underside of the cap are separated by 0.25 to about 2 inches.

3. The method of claim 2 wherein the small accelerator openings have a hydraulic cross section of about 10 square millimeters or less.

4. The method of claim 2 wherein the small accelerator openings have a hydraulic cross section of about 4 square millimeters or less.

5. The method of claim 2 wherein the small accelerator openings have a hydraulic cross section of about 2 square millimeters or less.

6. The method of claim 1 wherein the small bubbles have an average internal diameter of about 4 millimeters or less.

7. The method of claim 1 wherein the small bubbles have an average internal diameter of about 2 millimeters or less.

8. The method of claim 1 wherein the system steps (b), (c), (d), (e) and (f) comprise a first water stage.

9. The method of claim 8 wherein the first cleaned smoke stream is fed as a smoke filled air stream to a second water stage to repeat the system steps (b), (c), (d), (e) and (f) to form a second cleaned smoke stream.

10. The method of claim 9 wherein the second cleaned smoke stream is fed as a smoke filled air stream to a third water stage to repeat the system steps (b), (c), (d), (e) and (f) to form a third cleaned smoke stream.

11. The method of claim 1 wherein the outer housing is substantially tilted away from vertical so that a side of the second annular space in the tilt direction contains substantially more water based liquid than an opposite side of the second annular space, whereafter about the same gas stream flow is maintained through the small accelerator openings as compared with the gas stream flow while the outer housing is vertical.

12. The method of claim 1 wherein the first cleaned smoke stream comprises a substantial amount of water droplets and is flowed to a demister in the bore to substantially eliminate the water droplets to form a demisted smoke stream.

13. The method of claim 12 wherein the demister provides a second plate that seals the bore except for a second opening in the second plate about the bore axis and also providing an enclosure for the second opening a demister cap on top of demister walls that extend up from a top surface of the second plate to define a demisting space and a third annular space between an outside surface of the demister walls and an inside surface of the bore, where demister openings are provided at a lowest part of the walls between the demister space and the third annular space and one or more slots radial to the bore axis are formed in the demister walls between the demister space and the third annular space.

14. The method of claim 13 wherein the first cleaned smoke stream flows into the demister space and water droplets adhere to a bottom surface of the demister cap.

15. The method of claim 14 wherein the first cleaned smoke stream flows into the demister space and out through the slots to water droplets on the inside surface of the bore.

16. The method of claim 15 wherein water drains through the demister openings to the second opening and then down to a water stage.

* * * * *